US005961347A

United States Patent [19]

Hsu

[11] Patent Number: 5,961,347

[45] Date of Patent: Oct. 5, 1999

[54] MICRO CONNECTOR

[75] Inventor: Sung-Liu Hsu, Taipei Hsien, Taiwan

[73] Assignee: Hon Hai Precision Ind. Co., Ltd., Taipei Hsien, Taiwan

[21] Appl. No.: 08/904,215

[22] Filed: Jul. 31, 1997

[30] Foreign Application Priority Data

Sep. 26, 1996 [TW] Taiwan ..... 85215053

[51] Int. Cl.[6] ..... H01R 13/60

[52] U.S. Cl. ..... 439/570; 439/83

[58] Field of Search ..... 439/83, 570, 571, 439/572, 607

[56] References Cited

U.S. PATENT DOCUMENTS 3,803,533 4/1974 Taplin ..... 439/571 X 4,645,287 2/1987 Olsson ..... 439/571 X 5,622,519 4/1997 Bixler et al. ..... 439/571 X

*Primary Examiner*—Khiem Nguyen

[57] ABSTRACT

An arrangement for mounting a micro connector to a PCB is disclosed. The arrangement comprises a pair of fixing blocks formed on the connector, each defining a U-shaped groove recessed on a surface of the fixing block. The arrangement also comprises a pair of fixing pieces, each including an elongated main plate closely abutting an inner surface of the groove and a pair of leg plates extending outward from the main plate for mounting onto the PCB. The arrangement further comprises a plurality of retention slots on both side of the grooves and the fixing pieces further comprises a plurality of retention tabs extending from both lateral edges of the fixing blocks. The retention tabs are inserted in the retention slots and firmly retain on inner walls of the retention slots. A fixing piece used in the above-mentioned arrangement is also addressed.

11 Claims, 4 Drawing Sheets

MICRO CONNECTOR

BACKGROUND OF THE INVENTION

1. Field of the Invention

The invention relates to a micro electrical connector, particularly to a micro electrical connector having fixing means for mounting onto a printed circuit board by SMT (Surface Mount Technology).

2. The Prior Art

SMT has been used in mounting micro electrical connectors onto a printed circuit board (PCB) to meet the smaller and smaller size requirement of the electrical connectors. Some conventional devices have been developed to fix a micro connector onto a PCB before wave soldering procedure of SMT to prevent undesired dislocating of the micro connector on the PCB, which devices can be found in, for example, Taiwan Patent Application No. 79211295, U.S. Pat. Nos. 2,627,385, 4,639,066, 4,721,473, 4,842,552, 4,983,704, 4,943,244, 5,024,607, and 5,085,589. These fixing devices, however, provide merely positioning forces enough for wave soldering purpose, rather than fixing forces enough to firmly retain the connector on the PCB for sustaining external forces due to repeated insertion and removal of a mating connector or electrical component. Therefore, a connector using these fixing devices will encounter the problem that their contacts take too much external force while a mating electrical component is inserted into or removed from it. In the long run, the soldering portions of the contacts will be loosened or even detached from the PCB, causing poor transmission of electrical signals or even short circuits. A solution was proposed in Taiwan Patent Application No. 80212589, which solution, however, did not completely overcome the shortcoming above mentioned.

Hence, there is a need for an electrical connector having fixing means that can overcome the above-mentioned shortcoming.

SUMMARY OF THE INVENTION

Accordingly, one main object of the present invention is to provide a micro electrical connector having fixing means, which fixing means provides both positioning forces enough for wave soldering purpose and fixing forces enough to firmly retain the connector on the PCB.

To fulfill the above-mentioned objects, according to one embodiment of the present invention, an arrangement for mounting a connector to a PCB comprises a pair of fixing blocks formed on the connector, each defining a groove recessed on a front, an upper and a rear surface thereof; and a pair of fixing pieces, each including an elongated main plate closely abutting an inner surface of the groove of the fixing block and a pair of leg plates extending outward from a front and a rear edge of the main plate for mounting onto a surface of the PCB.

In one preferred embodiment, each of the fixing blocks further comprises a plurality of retention slots on both side of the groove and each of the fixing pieces further comprises a plurality of retention tabs extending from both lateral edges thereof wherein the retention tabs are inserted in the retention slots and firmly retain on inner walls of the retention slots.

In one aspect, according to the present invention, a fixing piece for mounting a connector to a PCB comprises an elongated main plate having downward bending vertical end portions; a pair of enlarged horizontal leg plates extending outward from a front and a rear edge of the main plate; and two rows of vertical retention tabs extending downward from both lateral edges of the main plate.

These and additional objects, features, and advantages of the present invention will be apparent from a reading of the following detailed description of the embodiments of the invention taken in conjunction with the appended drawing figures, which are described briefly immediately below.

DETAILED DESCRIPTION OF THE PREFERRED EMBODIMENTS

Figure 1:
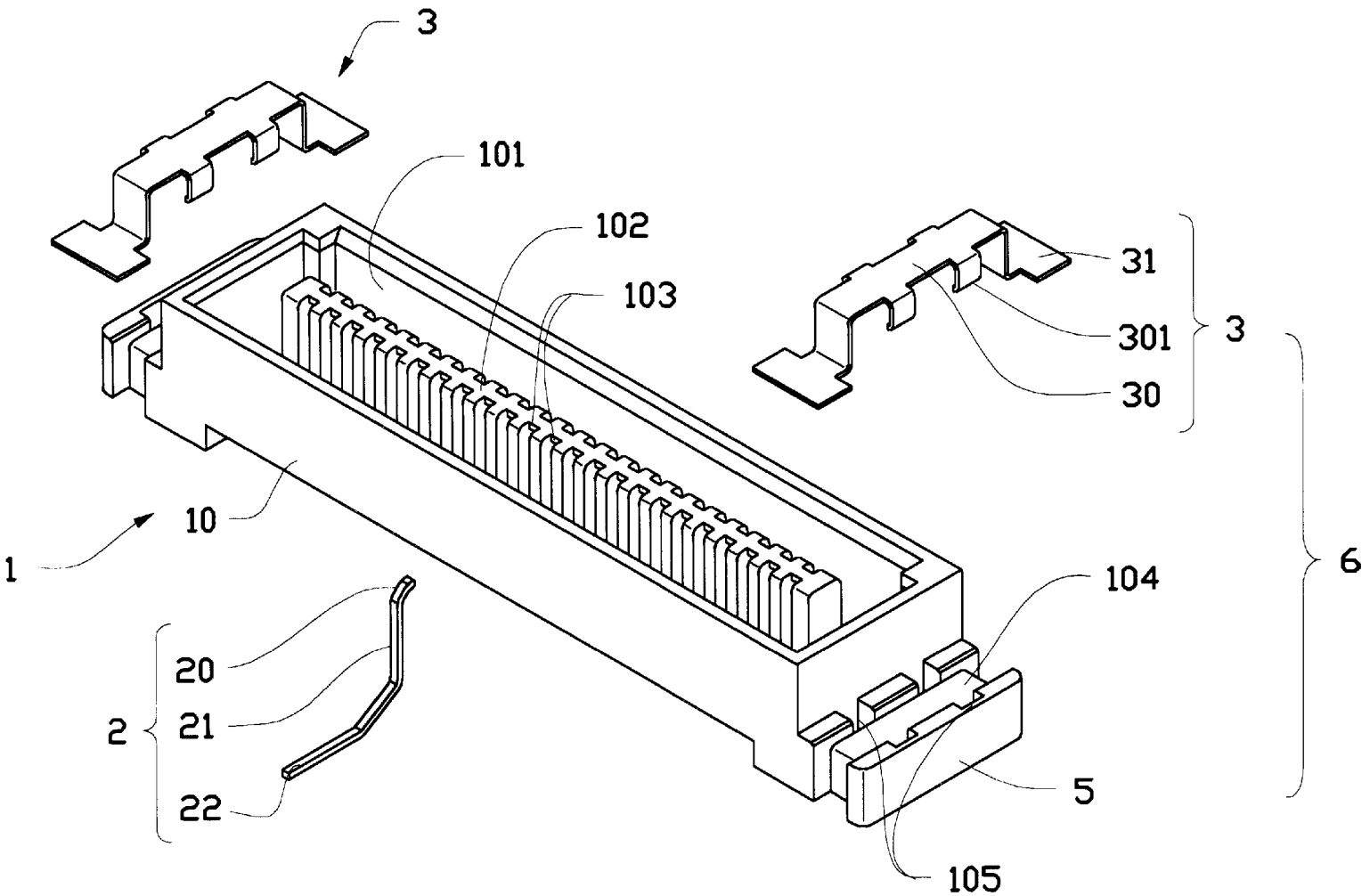
FIG. 1 is an exploded perspective view of a micro electrical connector having fixing means according to one embodiment of the present invention.

Reference will now be made in detail to the preferred embodiments of the present invention. It will be noted here that for a better understanding, most of like components are designated by like reference numerals throughout the various figures in the embodiments.

Figure 2:
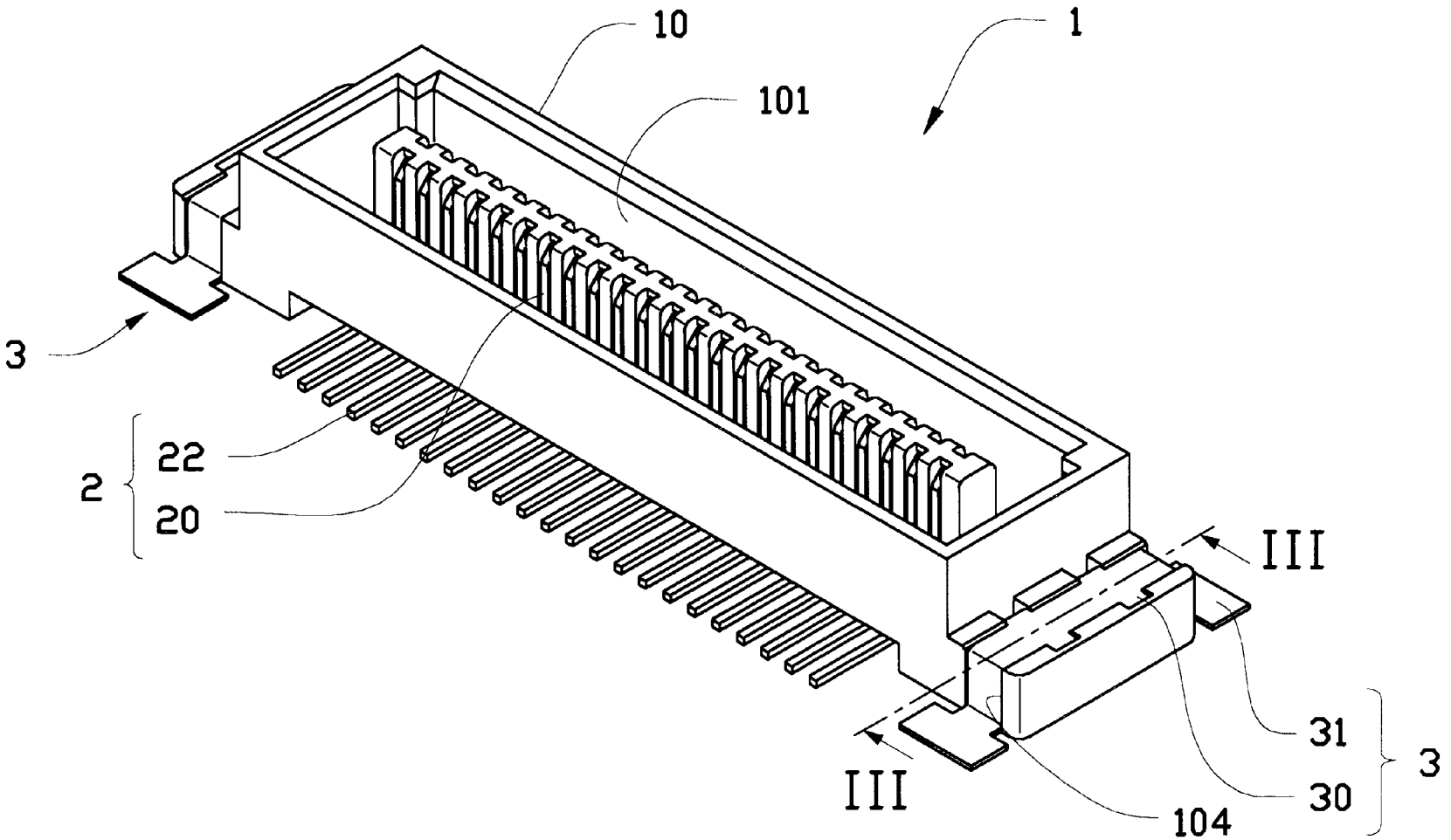
FIG. 2 is an assembled perspective view of the micro electrical connector shown in FIG. 1.

Referring to FIGS. 1 and 2, a micro electrical connector having fixing means according to the present invention is generally designated at 1. The electrical connector 1 mainly comprises an elongated insulating housing 10 defining a longitudinal direction, a plurality of contacts 2 received in the housing 10, and a pair of fixing devices 6 formed on both longitudinal ends of the housing 10.

The housing 10 comprises a central cavity 101 open to the top, a central island 102 formed on the cavity 101, and two rows of passageways 103 formed on a front and a rear side of the island 102 for receiving a corresponding number of conductive contacts 2.

Each of the conductive contacts 2 comprises a vertical fixing section 21, a slant contacting section 20 integrally formed on an upper end of the fixing section 21, and a horizontal soldering section 22 integrally extending from a lower end of the fixing section 21. When the contact 2 is mounted in the housing the fixing section 21 is vertically fitted in the passageway 103 with the contacting section 20 resting on an upper portion of the passageway 103, and the soldering section 22 horizontally extends out of a bottom of the housing 10 for wave soldering onto a PCB.

Figure 3:
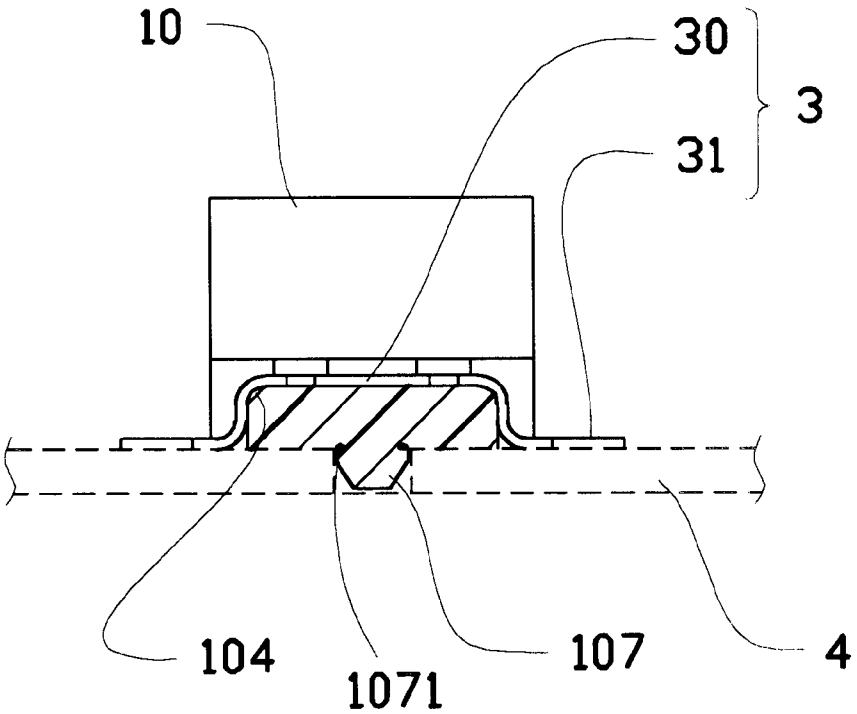
FIG. 3 is a cross-sectional view of the micro electrical connector shown in FIG. 2, taken along line III—III thereof.
Figure 4:
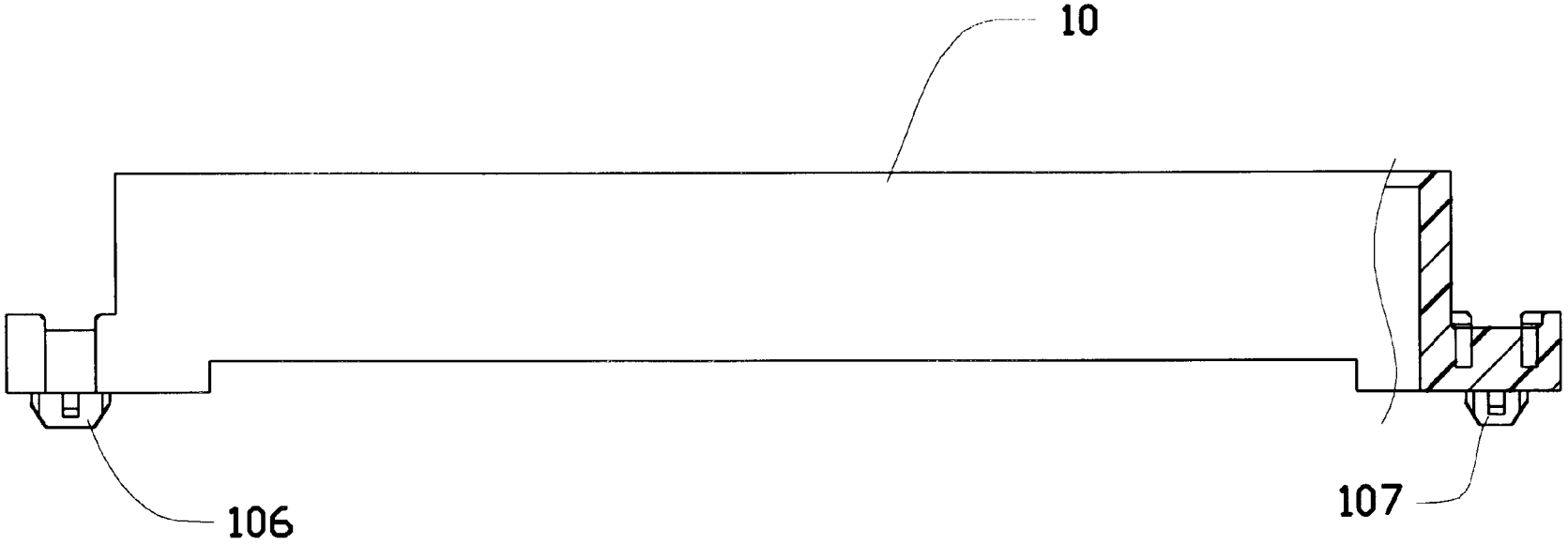
FIG. 4 is a partially cross-sectional view of a housing of the micro electrical connector shown in FIG. 2, showing the mounting slots of the fixing block.

The housing 10 also comprises a pair of fixing devices 6 formed on both longitudinal ends thereof for mounting onto a PCB 4 (shown in FIG. 3). Each of the fixing devices 6 includes a fixing block 5 laterally protruding from one of the longitudinal ends of the housing 10 and a fixing piece 3 mounted on the fixing block 5. The fixing block 5 defines an inverted U-shaped surface groove 104 continuously recessed on a front surface, an upper surface and a rear surface of the fixing block 5, forming a front, an upper and a rear recess on the fixing block 5. The fixing block 5 also defines two pairs of opposed vertical retention slots 105 on both lateral sides of the upper recess of the groove 104. The fixing piece 3 is of an inverted U shape and comprises an elongated horizontal main plate 30 having downward bending vertical end portions, a pair of enlarged horizontal leg plates 31 extending outward from a front and a rear edge of the main plate 30, and two pairs of opposed vertical retention tabs 301 extending downward from front and rear lateral edges of the main plate 30.

When mounting the connector 1 onto the PCB 4, first, the fixing pieces 3 are firmly attached to the fixing blocks 5, and then, fixing pieces 3 are further mounted onto the PCB 4 so as to securely fix the fixing blocks 5 on the PCB 4. When the fixing piece 3 is attached to the fixing block 5, the main plate 30 closely abuts the groove 104 with a flat, elongated portion thereof closely abutting an inner surface the upper recess of the groove 104 and with the two vertical end portions closely abutting inner surfaces of the front and the rear recesses of the groove 104, and the two pairs of opposed vertical retention tabs 301 are inserted in the two pairs of opposed vertical retention slots 105 of the fixing block 5 and firmly grasp inner walls of the retention slots 105.

After the fixing pieces 3 are firmly attached to both longitudinal ends of the housing 10, the fixing pieces 3 are welded onto the surface of PCB 4 by the horizontal leg plates 31. Thus, the connector 1 is securely mounted on the PCB 4 by the two fixing devices 6 including the fixing blocks 5 and the fixing pieces 3, rather than by the solders around the soldering sections 22 of the contacts 2. The only function of the solders around the soldering sections 22 and the contacting areas of the PCB 4 is to keep good electrical connection therebetween. Therefore, external forces due to insertion or removal of a mating connector or electrical component will mostly be taken up by the fixing devices 6 and have little influence on the soldering areas of the contacts 2. Consequently, the present invention not only provides positioning forces enough for wave soldering purpose, but also provides fixing forces large enough to firmly retain the connector 1 on the PCB 4 for sustaining external forces due to repeated insertion and removal of a mating electrical component.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. An arrangement for mounting a first article to a second article, comprising:

a pair of fixing blocks formed on the first article, each block having a groove recessed on at least an upper surface thereof and a plurality of retention slots; and a pair of fixing pieces, each including an elongated main plate closely abutting an inner surface of the groove of the fixing block, a pair of leg plates extending outward from a front edge and a rear edge of said main plate for mounting onto a surface defined on said second article, and a plurality of retention tabs extending from both lateral edges of the main plate for being inserted in and firmly retained on the retention slots.

2. The arrangement as claimed in claim 1, wherein said first article includes an elongated micro electrical connector defining a longitudinal direction, and said fixing blocks are a pair of blocks projecting laterally from both longitudinal ends of said connector; said second article includes a printed circuit board to which said connector is to be mounted.

3. The arrangement as claimed in claim 1, wherein said groove of each of the fixing blocks comprises continuous front, upper and rear recesses.

4. The arrangement as claimed in claim 2, wherein each of said grooves of the fixing blocks is an inverted U-shaped groove comprising continuous front, upper and rear recesses and each main plate of said fixing pieces is of an inverted U shape conforming to the inner surface of the groove.

5. The arrangement as claimed in claim 4, wherein said connector comprises an elongated insulating housing defining the longitudinal direction, a plurality of conductive contacts received in the housing, and the pair of fixing blocks formed on both longitudinal ends thereof.

6. An arrangement for mounting a first article to a second article, comprising:

a pair of fixing blocks formed on the first article, each defining two rows of retention slots; and a pair of fixing pieces, each including an elongated main plate, a pair of leg plates extending outward from a front edge and a rear edge of said main plate for mounting onto a surface defined on said second article, and a plurality of retention tabs extending from both lateral edges thereof, said retention tabs being inserted in said retention slots and firmly retaining on inner walls of said retention slots; wherein each of said fixing blocks further comprises a groove is recessed on a front, an upper and a rear surface thereof and formed between said two rows of retention slots, whereby each of said main plates closely abuts an inner surface of one of the grooves of the fixing blocks.

7. The arrangement as claimed in claim 6, wherein said first article includes an elongated micro electrical connector defining a longitudinal direction, and said fixing blocks are a pair of blocks projecting laterally from both longitudinal ends of said connector; said second article includes a printed circuit board to which said connector is to be mounted.

8. The arrangement as claimed in claim 7, wherein said groove of each of the fixing blocks comprises continuous front, upper and rear recesses.

9. The arrangement as claimed in claim 8, wherein each of said grooves of the fixing blocks comprises continuous front, upper and rear recesses to form an inverted U-shaped groove and each main plate of said fixing pieces is of an inverted U shape conforming to the inner surface of the groove.

10. The arrangement as claimed in claim 9, wherein said connector comprises an elongated insulating housing defining the longitudinal direction, a plurality of conductive contacts received in the housing, and the pair of fixing blocks formed on both longitudinal ends thereof.

11. An arrangement for mounting a first article to a second article, comprising:

a pair of fixing blocks formed on the first article, each block having a groove and two rows of retention slots; and a pair of fixing pieces, each including an elongated main plate received in the groove, a pair of leg plates extending outward from a front edge and a rear edge of said main plate for mounting onto a surface defined on said second article, and a plurality of retention tabs downwardly extending from both lateral edges of the main plate, said retention tabs being inserted in said retention slots and firmly retaining on inner walls of said retention slots.

* * * * *